US010655618B2

(12) United States Patent
Crowley

(10) Patent No.: US 10,655,618 B2
(45) Date of Patent: May 19, 2020

(54) NEAR ISOTHERMAL MACHINE

(71) Applicant: Michael Crowley, Frampton on Severn (GB)

(72) Inventor: Michael Crowley, Frampton on Severn (GB)

(73) Assignee: Michael Crowley, Frampton on Severn (GB)

( * ) Notice: Subject to any disclaimer, the term of this patent is extended or adjusted under 35 U.S.C. 154(b) by 149 days.

(21) Appl. No.: 15/574,599

(22) PCT Filed: May 23, 2016

(86) PCT No.: PCT/GB2016/051476

§ 371 (c)(1),
(2) Date: Nov. 16, 2017

(87) PCT Pub. No.: WO2016/189289

PCT Pub. Date: Dec. 1, 2016

(65) Prior Publication Data

US 2018/0142681 A1 May 24, 2018

(30) Foreign Application Priority Data

May 27, 2015 (GB) ..... 1509039.2
Jul. 20, 2015 (GB) ..... 1512740.0

(51) Int. Cl.
*F04B 39/06* (2006.01)
*F04B 37/10* (2006.01)
(Continued)

(52) U.S. Cl.
CPC ..... *F04B 39/06* (2013.01); *F02G 1/043* (2013.01); *F04B 37/10* (2013.01); *F25B 9/14* (2013.01); *F28F 3/025* (2013.01)

(58) Field of Classification Search
CPC ..... F02G 1/043; F03B 39/06; F03B 37/10; F04B 39/06; F04B 37/10
See application file for complete search history.

(56) References Cited

U.S. PATENT DOCUMENTS

2011/0239640 A1 11/2011 Charlat
2011/0314803 A1 11/2011 McBride
(Continued)

FOREIGN PATENT DOCUMENTS

CN 203420852 2/2014
DE 37 05 053 9/1988
(Continued)

OTHER PUBLICATIONS

International Search Report for PCT/GB2016/051476 dated Aug. 24, 2016, 2 pages.

*Primary Examiner* — Michael Leslie
*Assistant Examiner* — Daniel S Collins
(74) *Attorney, Agent, or Firm* — Nixon & Vanderhye P.C.

(57) ABSTRACT

A machine for compressing or expanding gas comprises a piston operating downwards in a compression stroke with respect to an inclined or vertical cylinder and upwards with respect to the cylinder in an expansion stroke. The piston has a heat absorbing and releasing structure attached to its bottom face. There is a gap between the piston and the base of the cylinder when the gas volume in the cylinder is at its minimum. The gap contains a hydraulic fluid which absorbs heat from the heat absorbing and releasing structure. A heat transfer surface containing fluid circulating to and from an external source maintains the hydraulic fluid at constant temperature. In one arrangement the heat absorbing and releasing structure comprises thin sheets of aluminium attached orthogonally to the bottom face of the piston.

9 Claims, 10 Drawing Sheets

(51) Int. Cl.

| | |
|---|---|
| ***F02G 1/043*** | (2006.01) |
| ***F25B 9/14*** | (2006.01) |
| ***F28F 3/02*** | (2006.01) |

(56) References Cited

U.S. PATENT DOCUMENTS

| | | | |
|---|---|---|---|
| 2013/0192216 | A1 | 8/2013 | Berlin, Jr. et al. |
| 2015/0110647 | A1 | 4/2015 | Wilhelm |

FOREIGN PATENT DOCUMENTS

| | | |
|---|---|---|
| FR | 2 959 282 | 10/2011 |
| GB | 2 002 457 | 2/1979 |

NEAR ISOTHERMAL MACHINE

This application is the U.S. national phase of International Application No. PCT/GB2016/051476 filed May 23, 2016 which designated the U.S. and claims priority to GB 1509039.2 filed May 27, 2015 and GB 1512740.0 filed Jul. 20, 2015, the entire contents of each of which are hereby incorporated by reference.

TECHNICAL FIELD

This invention relates to a machine to achieve near isothermal compression and expansion of a gas using a reciprocating piston inside a cylinder.

When compressing or expanding a gas, for a given volume ratio, the closer the process is to isothermal, the more energy efficient it is. In the case of compression less power is required and in the case of gas expansion more power is produced.

In addition to the obvious application of providing compressed gas more economically, this invention address a number of potential applications, which are currently limited by the relative inefficiency of existing technologies.

PRIOR ART

Compressed air energy storage is being proposed as a means of large scale power storage for electrical grids. With near isothermal compression and expansion the cycle efficiency of compressed air energy storage can be significantly increased. This invention has the potential to significantly improve the efficiency of such systems and make them more economically viable.

The use of liquefied air is a potential new way of energy storage. Developments include a grid power storage systems using liquid air, and an engine has been developed which is powered by liquid air. This engine could be used in a vehicle as an alternative to the zero emissions electric vehicle. Liquid air is produced commercially by using compressed air. This invention could significantly reduce the power required to produce liquid air and so make this technology more viable.

The efficiency of the internal combustion engine is in part limited by the maximum compression ratio; if higher compression ratios could be used then engine efficiency could be improved. With the traditional Otto cycle as the fuel air mixture is compressed adiabatically the gas heats up, if the compression ratio is too high pre-ignition will occur. In the case of a gas turbine high compression ratios results in excessive compressor blade temperatures. By improving the efficiency of gas compression and expansion, it would be possible to separately compress the air or air fuel mixture at relatively moderate temperature to much higher compression ratios and then transfer the air or air fuel mixture to a separate turbine or cylinder for combustion and so improve the efficiency of the engine.

For a Stirling heat pump to be efficient it requires the expansion and compression of the gas to be close to isothermal. Good heat transfer is also required between the working gas inside the pump and heat transfer surfaces on the outside. In practice it is very difficult in a traditional Stirling heat pump to achieve isothermal compression and expansion and it is difficult to transfer the heat across the pump.

Previous proposals to improve the efficiency of compassion and expansion are seen in PTL 0001: US 2011314803 A (MCBRIDE). 2011 Nov. 29. and PTL 0002: US 2013192216 A (LIGHT SAIL ENERGY). 2011 Jul. 27.

In both cases, the systems involve a piston operating vertically upwards into a cylinder and spaying onto the cylinder head or injecting onto the cylinder water. In both cases the systems are relatively complex and require additional power. In neither case is it possible to use the system as part of a Sterling heat pump and in the case of US2013104533, at least, is only suitable for large scale installations In PTL 0003: US 2011231640 A (STIRAL). 2011 Sep. 22.

a thermodynamic machine includes at least one chamber in which an isothermal expansion and/or compression is to be carried out, said chamber being longitudinally defined by first and second walls that are mobile relative to each other. The chamber is divided by partitions extending longitudinally from each of the first and second walls, the partitions being interleaved within each other, and the distance between the partitions extending from a same wall being such that the ratio between the distance squared and the cycle duration of the thermodynamic machine is lower than the average thermal diffusivity of the gas contained in the chamber. This arrangement, however, there is no way of controlling the temperatures within the chamber beyond the natural control imported by the structure of the device, and as a result there will be significant variations in the temperature, reducing the overall system efficiency. Furthermore, it is not possible to expel all the gas from the cylinder on the compression stroke, further reducing the overall efficiency.

PTL 0004: DE 3705053 A (RABIEN). 1988 Sep. 1.

apparently shows a theoretical Stirling cycle machine in which elements associated with the pistons are dipped into a fluid. However, the elements are insufficiently robust to provide adequate isothermal operation. If such a machine was constructed as shown and described, it would be very inefficient.

DISCLOSURE OF INVENTION

According to the present invention a machine for compressing or expanding gas temperature control comprises a piston, a cylinder inclined to the vertical or vertical, a heat absorbing and releasing structure comprising a plurality of bent elements attached to and disposed orthogonally the bottom of the piston, the piston operating downwards in a compression stroke with respect to a cylinder and upwards with respect to the cylinder in an expansion stroke, the cylinder containing a substantially constant volume of fluid maintained at a substantially constant temperature and a variable volume of gas, in which gas temperature is controlled to substantially the same temperature as the fluid by the movement with the piston of the heat absorbing and releasing structure between the variable gas volume and the fixed fluid volume.

In one embodiment a machine according to the invention comprises a piston operating downwards in a compression stroke with respect to a cylinder inclined to the vertical or vertical and upwards with respect to the cylinder in an expansion stroke, in which the there is a gap between the piston and the base of the cylinder when the piston is at bottom dead centre, the a heat absorbing and releasing structure being attached to the bottom face of the piston, and in which the space between the bottom of the piston at bottom dead centre and the base of the cylinder is filled with hydraulic fluid, and in which the temperature of the hydraulic fluid is maintained at a substantially constant temperature.

Ideally the heat absorbing and releasing structure and the piston have substantially the same cross section.

In one arrangement, the heat absorbing and releasing structure is out of the fluid when the volume contained by the piston in the cylinder is at its maximum.

By arranging the sheets in concentric arcs on the bottom face of the piston or in a corrugated structure the sheets are given a degree of stiffness preventing them bending into one another.

It has been found, too, if the ends of the sheets away from the bottom face of the piston are rounded toward the edges of the sheets, there is less of a tendency for the sheets to curl into one another.

If the lengths of adjacent sheets are staggered the mean active gap (where heat transfer between gas and the heat absorbing and releasing structure occurs) reduces as the compression ratio increases. This has a number of significant advantages.

The thermal diffusivity is inversely proportional to pressure so to maintain diffusivity with increasing pressure requires a reduction in heat absorbing and releasing structure spacing. Additionally most of the heat transfer occurs towards the end of the compression stroke so this is where best diffusivity is required.

Towards the end of the compression stroke the piston velocity is at its minimum. So the hydraulic forces between the fluid and heat absorbing and releasing structure are reduced and a higher density of heat absorbing and releasing structure can be accommodated.

It helps with draining and reduced foaming of the hydraulic fluid.

Another heat absorbing and releasing structure comprises parallel tubes whose axes are orthogonal the bottom face of the piston and in which the ends of each tube adjacent to the piston has a small radial hole.

A further heat absorbing and releasing structure comprises wires extending downwards from the bottom of the piston.

A still further heat absorbing and releasing structure comprises gauze attached to the bottom face of the piston.

It has been found that some fluid is lost from the cylinder in the expelled gas, this fluid should be replaced.

In a preferred arrangement fluid taken from the cylinder in the gas expelled is removed from the gas and recycled to the cylinder.

In one embodiment, the temperature of the hydraulic fluid in the bottom of the cylinder is maintain substantially constant by having a coil immersed in the hydraulic fluid, the coil has a fluid flow through it from an external source, the fluid in the coil heating or cooling the hydraulic fluid to maintain the temperature of the hydraulic fluid. Alternatively, a jacket through which water or other coolant flows around the bottom of the cylinder.

In practice there is some splashing of the fluid and formation of bubbles in the fluid at the bottom of the cylinder, from the movement of the heat absorbing and releasing structure into and out of the fluid. This has the effect particularly at high operating speeds of lowering the efficiency of the machine. To overcome this in a machine for compressing or expanding gas comprising a piston, a cylinder inclined to the vertical or vertical, a heat absorbing and releasing structure comprising a plurality of elements attached to and disposed orthogonally the bottom of the piston;

the piston operating downwards in a compression stroke with respect to a cylinder and upwards with respect to the cylinder in an expansion stroke;

the cylinder containing a substantially constant volume of fluid maintained at a substantially constant temperature and a variable volume of gas; and in which the gas temperature is controlled to substantially the same temperature as the fluid by the movement with the piston of the heat absorbing and releasing structure between the variable gas volume and the fixed fluid volume; the cylinder has one or more baffles mounted on the base of the cylinder and projecting upwards into the cylinder, the baffles having shapes corresponding to elements of the heat absorbing and releasing structure, and between which the elements of the heat absorbing and releasing structure may enter and leave as the piston reciprocates within the cylinder.

However, even with the measures set out above, the efficiency of the machine, although high, could be improved further. It can be shown that the isothermal efficiency of a machine according to the invention machine is a function of the Nusselt number, and the higher the Nusselt number the greater the efficiency. By using sheets of material wound into spirals for both the heat absorbing and releasing structure and the baffle and with the spiral of the heat absorbing and releasing structure nesting between the spiral of the baffle, air or other gas pumped by the piston is forced to travel at speed through the spiral passage making the flow turbulent rather than the flow being laminar with as appears to be the case with the other structures. This leads to a substantial increase in the Nusselt number and with it a significant increase in efficiency. To avoid restricting the flow of fluid at the bottom of the cylinder, and improving cooling efficiency holes are in the bottom of the spiral baffle; the holes do not need to be aligned, but there should be one in the bottom of every cylinder of the baffles or with least every 360 degree turn of the spiral baffle.

Using the invention it is possible to construct a Stirling cycle heat pump or engine the Stirling cycle heat pump or engine using two such machines one being a compressor and the other an expander.

Such a Stirling cycle device has a regenerative heat exchanger between the cylinders.

Preferably the regenerative heat exchanger is in the form of an inverted U. The shape is to allow liquid condensing in the heat exchanger to drain back to the cylinder from whence it came.

Ideally the working gas of the Stirling device is at a pressure higher than the vapour pressure of hydraulic fluid at the bottom of the cylinders.

This invention thus provides improved efficiency of compression and expansion of gases in near isothermal compression or expansion. Thus opening the way for improved compressed air energy and liquid air energy storage systems, and improved efficiency Otto engines.

By improving the efficiency of compression and expansion using this invention, it will be possible to design an efficient Stirling heat pump in which the heat transfer can be done efficiently. Thus a Stirling heat pump developed using this technology would be more energy efficient than the vapour compression technology used in most heat pumps.

BRIEF DESCRIPTION OF DRAWINGS

In order that the invention may be more fully understood, examples are described below with reference to the accompanying drawings, in which:

FIG. 5A is a side view of a piston used in this invention removed from its cylinder, with a baffle, FIG. 5B is a section on the line B-B of FIG. 5A; FIG. 5C is perspective view of the cylinder, heat absorbing and releasing structure, and FIG. 5D is a section on the line CC of FIG. 5A;

DESCRIPTION OF EXAMPLES

Figure 1A:
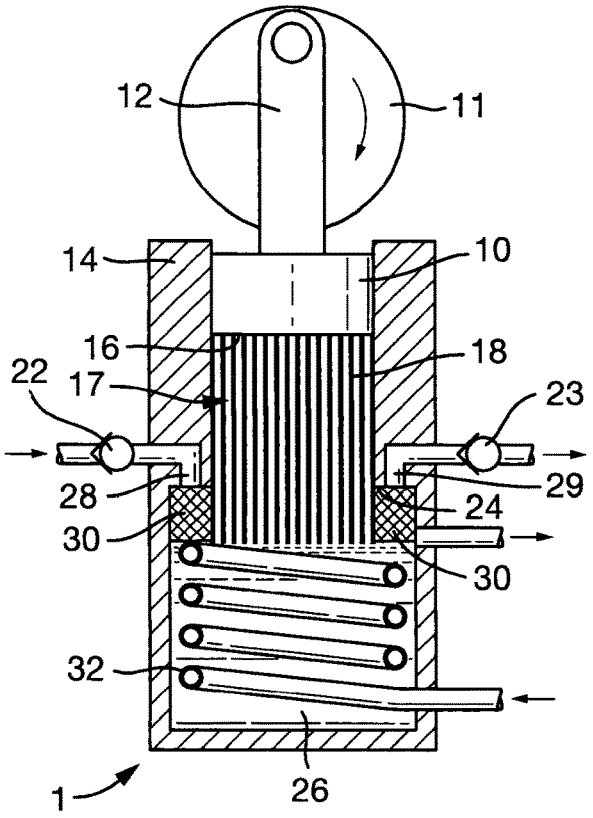
FIG. 1A is a schematic drawing of an near isothermal gas compressor according to the invention in the expanded position.
Figure 1B:
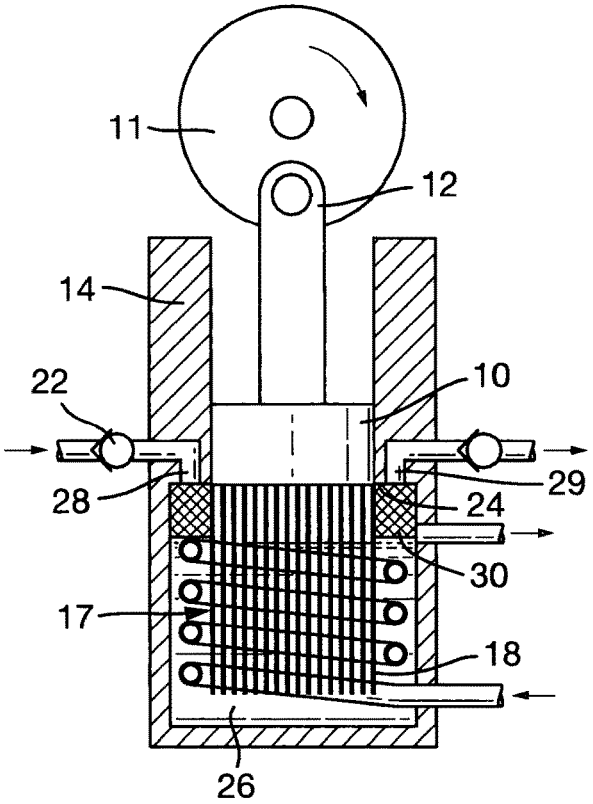
FIG. 1B is a schematic drawing of the same near isothermal gas compressor according to the invention in the compressed position.
Figure 2A:
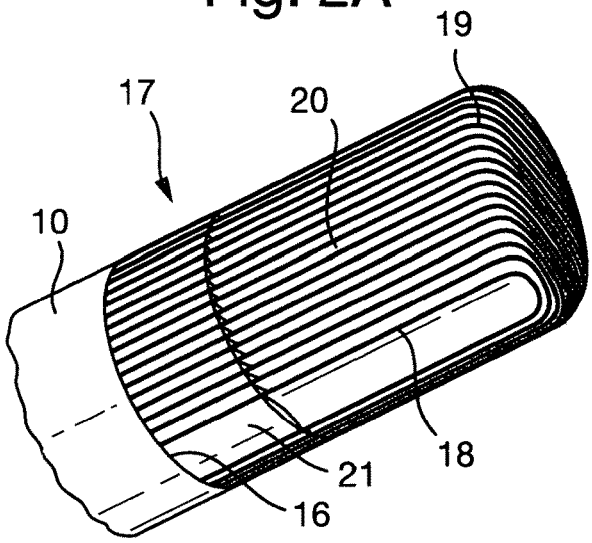
FIG. 2A shows a perspective view of part of the piston of the compressor of FIGS. 1A and 1B removed from its cylinder and lying on its side showing the a heat absorbing and releasing structure comprising a plurality of parallel sheets.
Figure 2D:
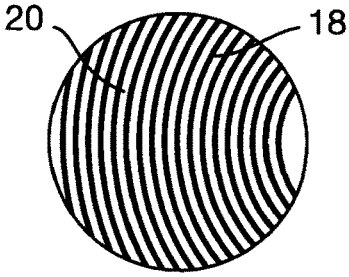
FIG. 2D is an end on view of the parallel sheets of FIGS. 2A to 2C, with the piston now obscured by the sheets.
Figure 2B:
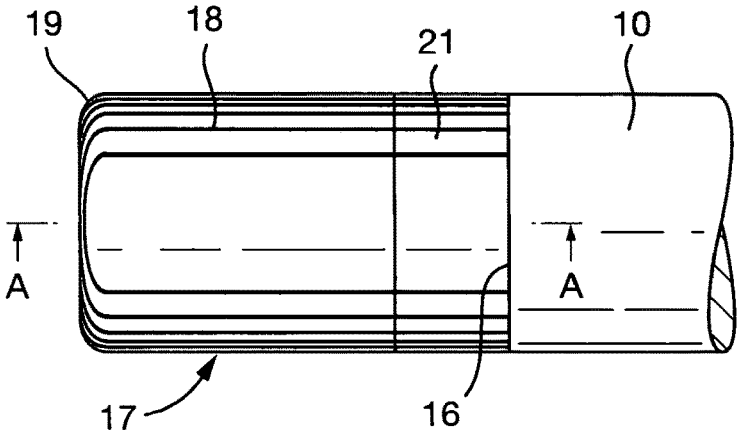
FIG. 2B shows side view of the cylinder and sheets of FIG. 2A.
Figure 2C:
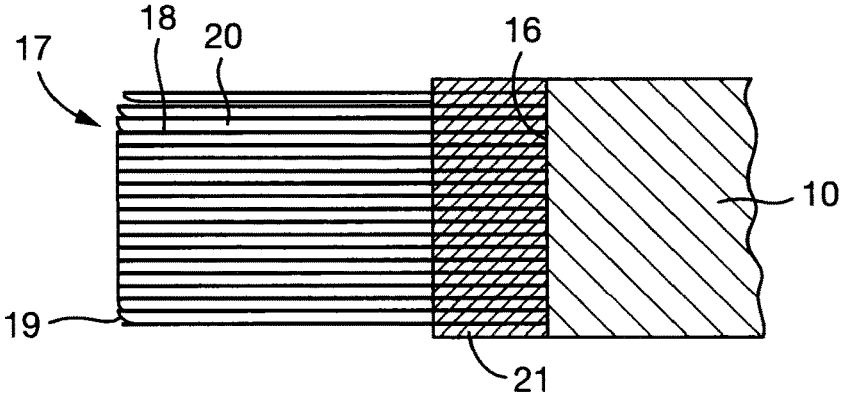
FIG. 2C is a section on the line A-A' of FIG. 2B.
Figure 3A:
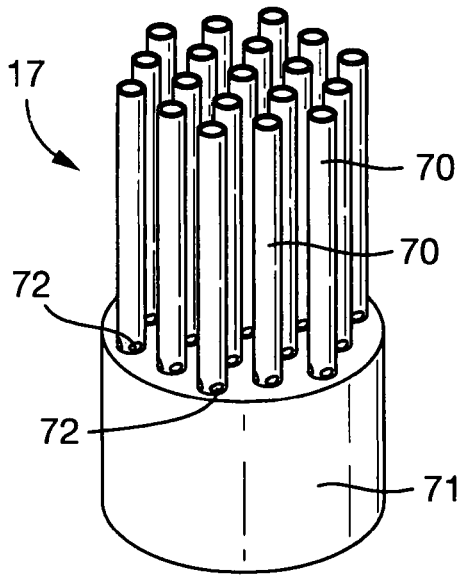
FIGS. 3A and 3B show a perspective view of an alternative heat absorbing and releasing structure comprising a plurality of parallel tubes.
Figure 3B:
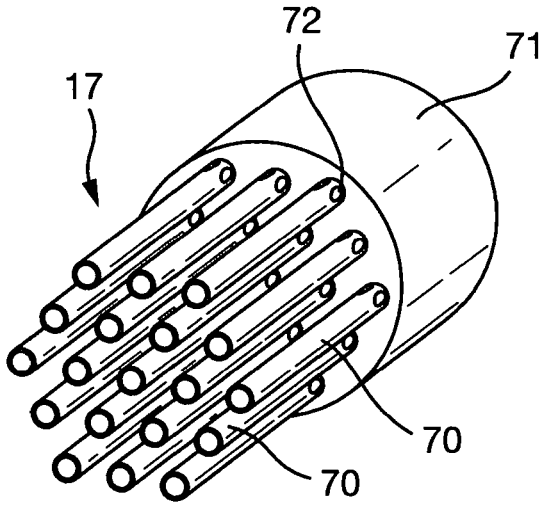
Figure 3C:
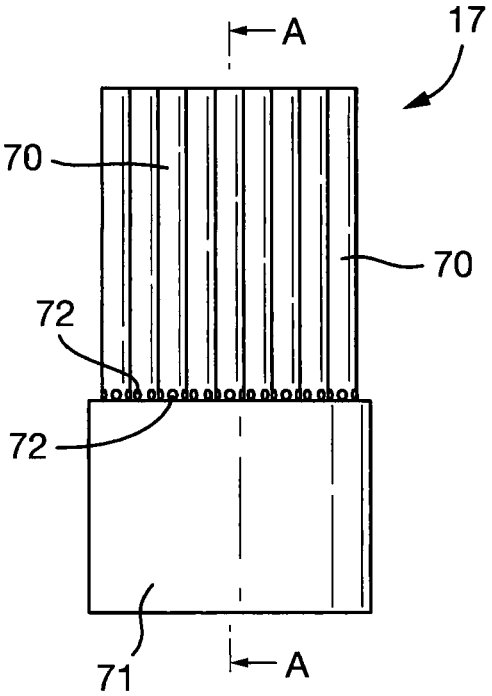
FIG. 3C shows side view of the tubes of FIGS. 3A and 3B.
Figure 3D:
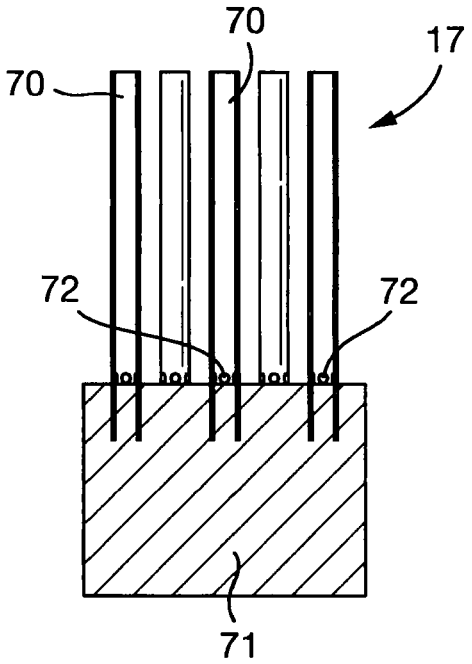
FIG. 3D is a section on the line A-A' of FIG. 3B.

In FIGS. 1A and 1B, a gas compressor 1 comprises a piston 10 driven from a crank 11 through a piston rod 12 into and out of a vertical cylinder 14. It should be noticed that in contrast to the systems described in US2011214803A and US 20133104533 the piston operates downwards into the cylinder 14 which is vertical or inclined to the vertical by up to about 45 degrees or more but not horizontal, in contrast to the systems described in those two publications in which the piston moves upwards into the cylinder. Attached to the downward face of the piston 16 is a plurality of parallel sheets 18 with small gaps between attached orthogonally to the downward face 16 of piston 10. The parallel sheets are described in more detail with reference to FIGS. 2A and 2B. The parallel sheets 18 form the heat absorbing and releasing structure 17 acting as thermal ballast tending to hold the temperature of the gas constant. Check valves 22 and 23 control flow of gas into and out of the compressor 1.

The internal diameter of the cylinder 14 has a step outwards 24, in line with the downward face 16 of the piston when it is at the end of its compression stroke as seen in FIG. 1B. The region of the cylinder below the downward face 16 of the piston 10 when the piston 10 is at the end of its compression stroke as in FIG. 1B is filled with hydraulic fluid 26. A gas inlet 28 to the cylinder 14 is provided above the step 24 from check valve 22. A gas outlet 29 from the cylinder 14 is provided above the step 24 to check valve 23. As seen in FIG. 1A the withdrawal of the heat absorbing and releasing structure 17 in the form of parallel sheets 18 from the hydraulic fluid 26 at the end of the expansion stroke causes the level of the hydraulic fluid to fall, leaving a void between the gas inlet and outlets 28 and the top of the hydraulic fluid 26. This void is filled with gauze 30, say of aluminium or aluminium alloy, which is corrosion resistant and acts as further a heat absorbing and releasing structure.

The hydraulic fluid 26 is cooled by a cooling coil 32 through which cooling fluid is passed the coil providing a heat transfer surface for the hydraulic fluid.

Normally the hydraulic fluid is water, but it can be other fluids for particular applications.

FIG. 1A shows the piston with its attached heat absorbing and releasing structure in its uppermost position (the volume of contained by the piston in the cylinder is at its maximum). FIG. 1B shows the piston 10 and the heat absorbing and releasing structure 17 attached fully inserted into cylinder 14 at the end of the compression stroke (the volume of contained by the piston in the cylinder is at its minimum).

The compressor in FIG. 1 can only be used as such because gas flowing in and out of the compressor is controlled by simple check valves 22 and 23 controlling flow from a low pressure inlet to a high pressure outlet. However by reversing the flow and controlling the valve opening and closing the machine would become an isothermal expander.

As the piston (FIG. 1A) moves into the cylinder the sheets 18 are plunged into the hydraulic fluid 26. This forces gas out from between the sheets 18 through and to the outlet 29 of the compressor. The heat from the compressing gas is absorbed by the parallel sheets 18 and gauze 30 and then transferred into the hydraulic fluid 26. The hydraulic fluid 26 provide three functions.

- It acts as a liquid piston forcing the gas out of the heat absorbing and releasing structures (the parallel sheets 18 and gauze 30 in the illustrated case);
- It acts as a heat transfer fluid, transferring heat from a heat absorbing and releasing structure to the fluid passing through the cooling coil 32;
- It can lubricate the cylinder 14/piston 10 interface.

Turning to FIGS. 2A to 2D, the heat absorbing and releasing structure of the invention 17 in the form of the parallel sheets 18 are attached to the bottom face 16 of piston, the width of the sheets 18 matches the width of the piston so that in cross section the sheets 18 and gaps 20 between them fill the same area as a parallel cross section of the piston itself. In this example the sheets 18 are aluminium or aluminium alloy 0.15 mm thick with 2 mm gaps 20—the thickness and spacing can vary from these particular measurements as can the material. The material of the plates is not critical but it is desirable that it is corrosion resistant and formed easily into sheets, Aluminium and its alloys meet this criterion. The outer ends of the sheets have radii 19 formed towards the edges, this is because if square corners were left they are apt to bend and the corner of one sheet would touch another. It should be further noted that the aluminium sheets are in the form of arcs of concentric circles—this arrangement adds stiffness to the sheets and to resist hydraulic and acceleration loadings which could bend the sheets and cause them to touch one another.

The orientation of the sheets 18 extending orthogonally from the bottom face 16 of piston 10 provided the minimum resistance to flow between them. Nominally the fluid (26 in FIGS. 1A and 1B) remains still and the sheets move in an out without the fluid 26 moving, in practice there is some movement because of fluid displacement caused by insertion of the sheets into the fluid 26. This displacement is about 15%. The aluminium sheets were fixed to the bottom face 16 of piston 10 in a former 21 using epoxy resin.

The gaps 20 between the sheets 18 is minimised to reduce thermal diffusivity but the size should be balanced against the additional energy loss due to increased hydraulic friction and increased volume occupied by the sheets which will increase the movement of the fluid in the bottom of the cylinder.

Thermal diffusivity is inversely proportional to pressure so to maintain diffusivity with increasing pressure requires a reduction in the spacing of the sheets. Additionally most of the heat transfer to the fluid occurs towards the end of the compression stroke so this is where best diffusivity is required.

Towards the end of the compression stroke the piston velocity is at its minimum. The hydraulic forces between the fluid and sheets are reduced and a higher density of sheets can be accommodated. This helps with draining and reduces foaming. Similarly by designing the sheets so they are out of the hydraulic fluid when the piston is at top dead centre has a similar effect.

Although in the description above thin aluminium or aluminium alloy sheets are described as the heat absorbing and releasing structure 17, the sheets could be made from any material, including injection moulded plastics, the sheets could be tapered too. Tubes could also be used. If parallel tubes are used holes need to be provided near the base face of the piston to allow gas to flow and escape from between the tubes.

As an alternative to the sheets being arranged in concentric arcs as shown in FIGS. 2A to D, added stiffness can be achieved by using corrugated sheets with the wave distributed across the width of the sheets.

A further alternative to the sheets in FIGS. 2A to 2D is shown in FIGS. 3A to 3D. In FIGS. 3A to 3D, the heat absorbing and releasing structure of the invention 17 in the form of a plurality of parallel tubes 70 mounted in a resin former 71 which is then glued to the bottom face 16 of piston 10 (see FIGS. 1A and 1B). The axes of the tubes are orthogonal to the base of the piston. Each tube 70 has adjacent to the former 71 one or more radial holes 72. The material and diameter of the tubes is not critical but it is desirable that it is corrosion resistant.

In practice it has been found that when the compressor/expander of FIGS. 1A and 1B was operated as speed with the fluid 26 being water, a water mist forms in the cylinder 14, and water was lost from the cylinder in the gas being expelled through valve 23. This loss if not replaced would prevent the satisfactory operation of this device, there was both a reduction in the compression ratio and a reduction in thermal ballast effect.

Figure 4:
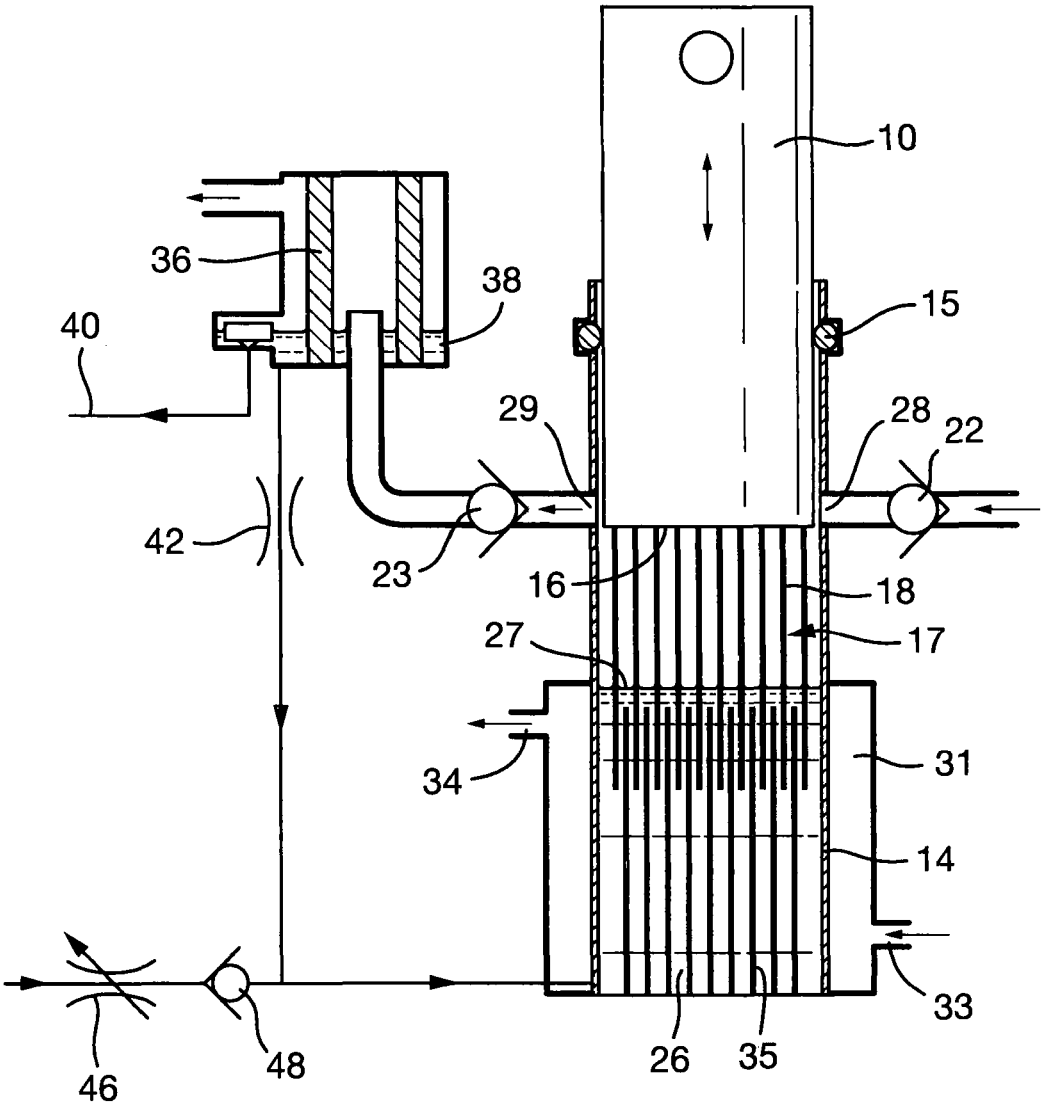
FIG. 4 is a schematic drawing of modified near isothermal machine.
Figure 5A:
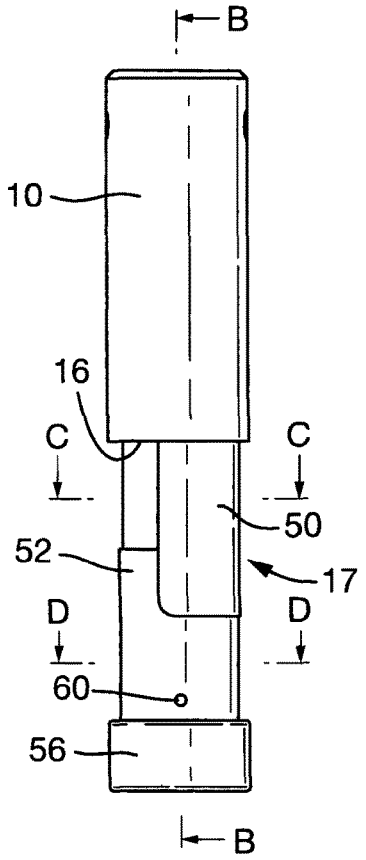
FIGS. 5A to 5D show an alternative structure for the heat absorbing and releasing structure also showing a corresponding baffle.
Figure 5B:
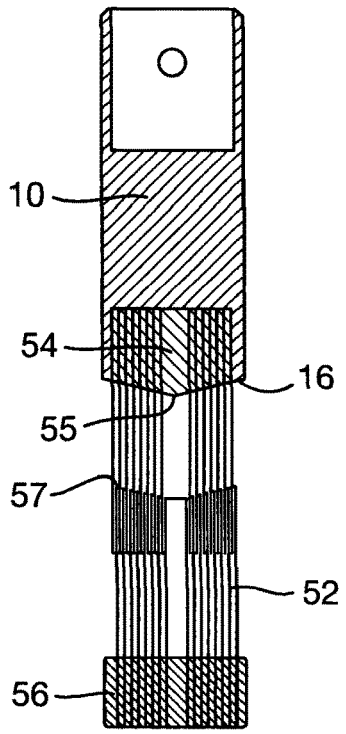
Figure 5D:
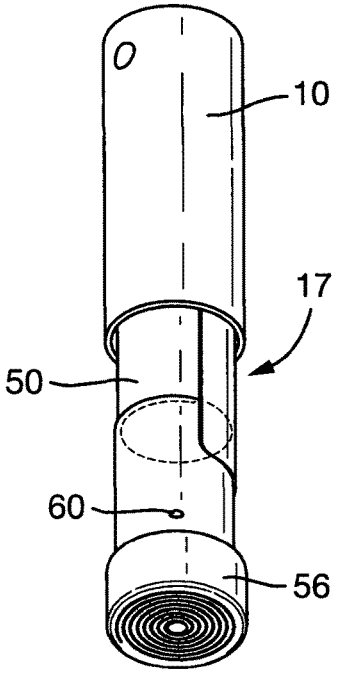
Figure 5C:
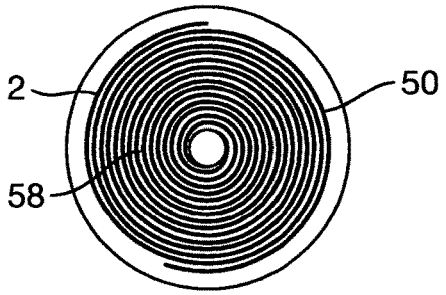

However, the water mist also had a positive effect. Under strobe lighting a water mist could be seen inside the cylinder 14 between the parallel sheets 18 above the surface of the water 26. This was the same water mist which was being expelled from the cylinder. It is believed that this water mist probably helps stabilisation of the gas temperature. The inventor believes that a thin film of water adheres by surface tension to the parallel sheets 18 as they are retracted from the fluid 26 (water in this case). This film then forms small water droplets under the reducing pressure which fall away from the parallel sheets forming the mist. Unfortunately the mist is expelled with the gas in the cylinder on compression As loss of fluid from the system is not acceptable, in further development of the invention, a system is provided to capture the expelled hydraulic fluid and recycle it. In addition it has been found that repeated immersion and withdrawal of the plates in FIG. 1 led to splashing and bubble formation in the fluid, which meant that the machine of FIG. 1 did not operate at its maximum potential efficiency. To overcome this baffles were provided in the bottom of the cylinder 14. Both developments are shown in FIG. 4.

A heat absorbing and releasing structure 17 comprises a plurality of parallel sheets 18. The top 27 of the fluid 26 is above the bottom face 16 of piston 10 when the piston is at bottom dead centre. The inlet gas 28 and outlet 29 are raised in the side of cylinder 14 above the water level 27. The gas entering the cylinder through inlet 28 first passes through a check valve 22. The outlet 28 leads to check valve 23 as before then to a fluid coalescer 36. Fluid (water in this example) 38 drops to the bottom of coalescer 36 and is returned to the cylinder through a metered duct 42. The metered flow is set to match the anticipated loss of fluid from the cylinder. Any excessive moisture in the gas passing through the coalescer 36 flow leaves though an automatic valve through pipe 40 to a drain. On the expansion stroke the pressure in the cylinder will be lower than the coalescer pressure so water can flow back from the tank through the metered duct 42. Should any topping up of the fluid in the cylinder be needed to ensure that the water level 27 is correct, this can be supplied through regulator 46 and one way valve 48. In addition to the simple inlet 28, nozzles can be provided to cause the incoming gas to swirl improving the thermal efficiency.

It is believed that the formation of mist assists the sheets 18 to perform their role in regulating the temperature of the gas in the cylinder. By modifying the surface finish, texture and material of the sheets it is believed possible to improve the positive misting effect and also reduce the adverse effects of bubble formation and gas/fluid mixing.

In this particular design a piston seal 15 set into the cylinder closes the top of the cylinder 14 against the piston 10.

The design assumes there is a small imbalance between the fluid separator/condenser water flow and the returned water flow from the tank. This imbalance can be positive or negative and both are possible so means to replace or drain water are required. For example if the air coming into the compressor is very dry, when it leaves the compressor it will have 100% humidity and possibly some free water as mist. The free water will be captured by the fluid separator/condenser but the water vapour (humidity) will be lost. Conversely if the air enters at 100% humidity and the isothermal compression ensures there is no significant temperature rise then the mass flow of water vapour in, is greater than the mass flow of water vapour out, so there will be a net flow of water into the system.

A baffle 35 is at the base of cylinder 14. The baffle comprises a plurality of up-standing sheets, the curvature corresponding to the curvature of sheets 18. The sheets of the baffle 35 are separated so that the sheets 18 can pass between them on the downward stroke of the cylinder. These arrangements reduces splashing as the sheets 18 rise and fall in cylinder 14 and also reduces bubble formation improving efficiency.

In the embodiment of FIG. 4, the cooling coil 32 of FIG. 1 is replaced by water jacket 31 around the lower part of the cylinder 14, with water flowing though water passing though the jacket 31 between an inlet 33 and outlet 34, the jacket forms a heat transfer surface for the fluid in the cylinder 14. Heat in the fluid (water in this case) in the bottom of the cylinder 14 is transferred to the water flowing through the water jacket, so tending to keep the temperature of fluid in the cylinder constant, creating the isothermal pumping condition sought.

However, it has been found that the efficiency of the machine of FIG. 4 can be improve further by replacing the sheets 18 of the absorbing and releasing structure 17 and the plates of baffle 35 with spiral sheets, the sheet of the absorbing and releasing structure passing between the spiral of the baffles. This is shown in FIG. 5.

In FIG. 5, the absorbing and releasing structure 17 comprises a spiral of aluminium 50, held in place and attached to the base 16 of cylinder 10 in former 54 and glued using epoxy resin. The baffle is formed of an complementary spiral of aluminium 52 held in place by a former 56, the baffle is mounted in the base of the cylinder, for example 14 in FIG. 4. The baffle has a plurality of holes 60 irregularly distributed around the lower part of spiral to allow for fluid flow out from between the spiral as the piston 10 lowers and into the spiral when the piston 10 is raised. As the piston 10 is lowered the spiral 50 forming the absorbing and releasing structure nests with the spiral baffle with a spiral path 58 for gas formed between the two spirals. As the piston 10 is lowered in cylinder 14, gas in between the spirals is forced out at speed, causing a turbulent flow which in turn substantially increases the Nusselt number and thus the efficiency of the machine. As an additional feature the former 54 connecting the spiral and the piston has a domed shape 55, likewise the top shape of the baffle is domes 57, the features helps maximise the gas expulsion from the spiral on the compression stroke.

Figure 6A:
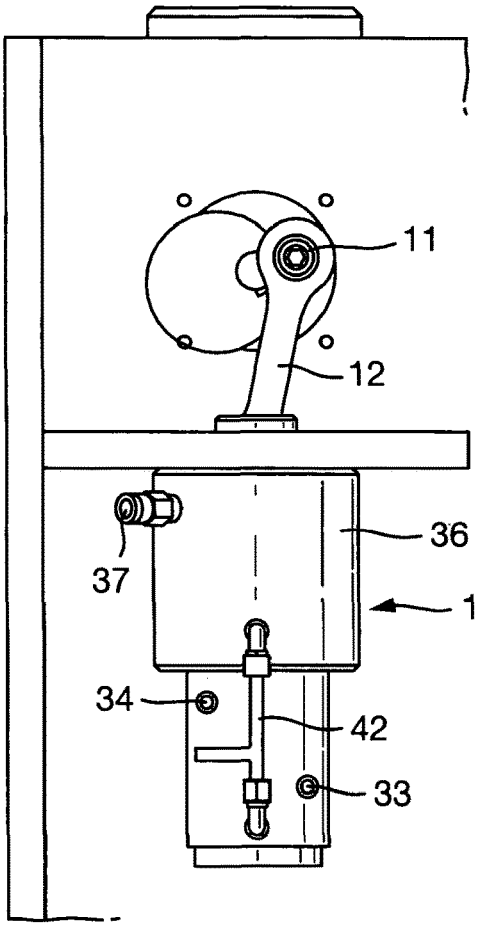
FIGS. 6A and 6B shows a practical implementation of the compressor of FIG. 4, FIG. 6A being a perspective view and FIG. 6B being a vertical section.
Figure 6B:
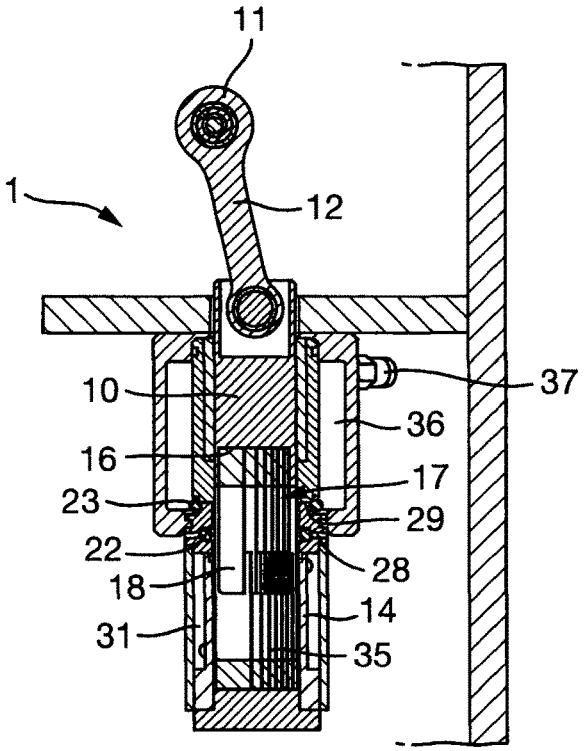

In FIGS. 6A and 6B showing an implementation of the schematic diagram of FIG. 3, a gas compressor 1 comprises a piston 10 driven from a crank 11 through a piston rod 12 into and out of a vertical cylinder 14. Attached to the downward face of the piston 16 is the heat absorbing and releasing structure 17 in the form of a plurality of sheets 18 with small gaps between attached orthogonally to the downward face 16 of piston 10. The sheets 18 are as described above in FIGS. 2A to 2D. The sheets 18 form the heat absorbing and releasing structure of the invention acting as thermal ballast tending to hold the temperature of the gas constant. Check valves 22 and 23 respectively allow gas into and out of the compressor 1. Valve 22 lifts inwards from its seating in the inlet 28 when pressure in the cylinder is low admitting more gas; valve 23 lifts from its seating in outlet 29 when gas pressure is high releasing gas.

The region of the cylinder below the downward face 16 of the piston 10 when the piston 10 is at the end of its compression stroke as in FIG. 1B is filled with hydraulic fluid (as in FIGS. 1A and 1B but omitted here for clarity).

The hydraulic fluid is cooled by passing water through jacket 31 between and inlet 33 and outlet 34 maintaining the temperature of the hydraulic fluid a close to constant as possible. The jacket 31 provides a heat transfer surface for the hydraulic fluid on the cylinder. Normally the hydraulic fluid is water, but is can be other fluids for particular applications.

A baffle 35 is at the base of cylinder 14. The baffle comprises a plurality of up-standing sheets, the curvature corresponding to the curvature of sheets 18. The sheets of the baffle 35 are separated so that the sheets 18 can pass between them on the downward stroke of the cylinder.

Gas pumped out of the cylinder is passed to a fluid coalescer 36, in this case in the form of a jacket around the upper part of the cylinder 14. Fluid (water in this example) drops to the bottom of condenser 36 and leaves though metered duct 42 to be returned to the bottom of the cylinder 14. The metering of returning fluid and any necessary topping up is carried out in an analogous way to that described with reference to FIG. 4.

The embodiments of FIGS. 7A and 7B, and 8A and 8B are similar to those of FIG. 4 but without a water jacket; cooling (in a compressor) or heating (in an expander) is achieved by air or gas circulation over an external feat exchanger.

A heat absorbing and releasing structure 17 comprises a spiral of aluminium 50, held in place and attached to the base of the cylinder 16 using epoxy resin. A baffle 52 mounted on the base of cylinder 14 is formed of a spiral of aluminium complementary to spiral 50 held in place by a former. Detail of the heat adsorbing and release structure 17 and baffle 52 is as shown in FIG. 5. The bottom of cylinder 14 contains water or other fluid 26; the top 27 of the fluid 26 is above the bottom face 16 of piston 10 when the piston is at bottom dead centre. The inlet gas 28 and outlet 29 are in the side of cylinder 14 above the water level 27. The gas entering the cylinder through inlet 28 first passes through a check valve 22. The outlet 28 leads to check valve 23 then to a fluid coalescer 36. Fluid (water in this example) 38 drops to the bottom of coalescer 36 and is passed to a header tank 44 through a duct 41. Fluid can be pumped back to the cylinder though pump 45 and heat exchanger 47, to reduce the temperature of the recovered fluid to the desired isothermal operating temperature, additional a top up facility ensures that fluid in the cylinder is at its desired height. Fluid passes back to the base of cylinder 14 through check valve 48. In addition to the simple inlet 28, nozzles can be provided to cause the incoming gas to swirl improving the thermal efficiency and ensure adequate heat transfer from the heat absorbing and release structure 17 without the need for a cooling jacket of the kinds shown in FIGS. 4 and 6. An accumulator 49 smooths the flow.

As mentioned above it is believed that the formation of mist assists the heat absorbing and release structure 17 to perform its role in regulating the temperature of the gas in the cylinder. By modifying the surface finish, texture and material of the spirals 50 it is possible to improve the positive misting effect and also reduce the adverse effects of bubble formation and gas/fluid mixing.

As in FIG. 4, in this particular design a piston seal 15 set into the cylinder closes the top of the cylinder 14 against the piston 10.

Figure 7A:
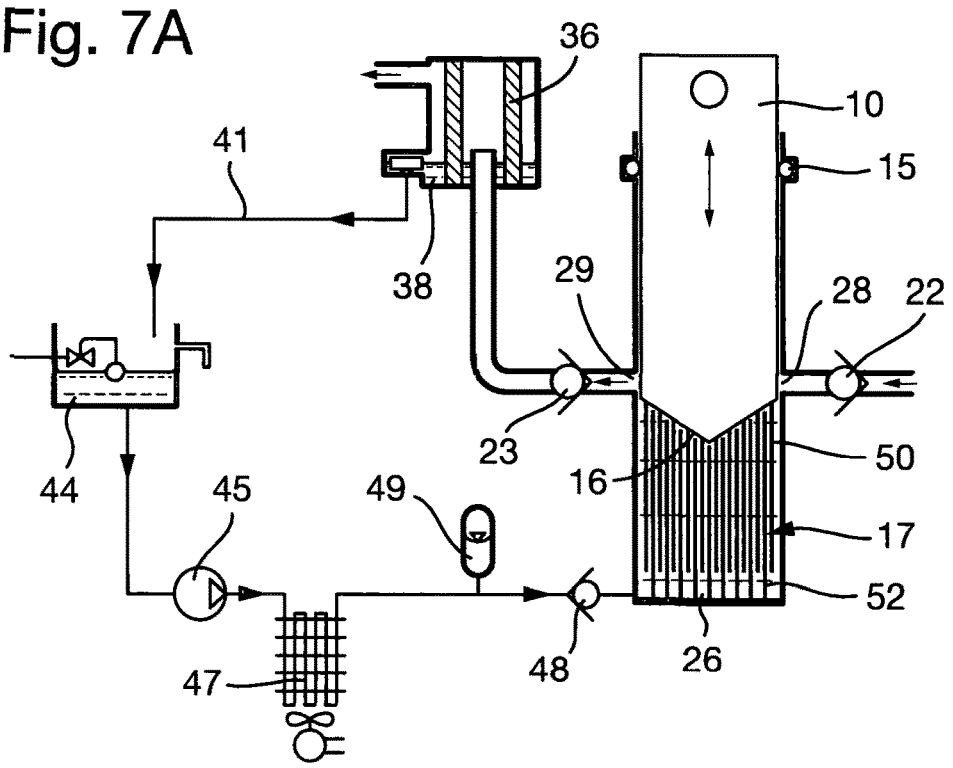
FIGS. 7A and 7B show a schematic view of a further embodiment of a near isothermal machine in accordance with the invention, in FIG. 7A the piston is inserted fully into the cylinder, and in FIG. 7B partially withdrawn.
Figure 7B:
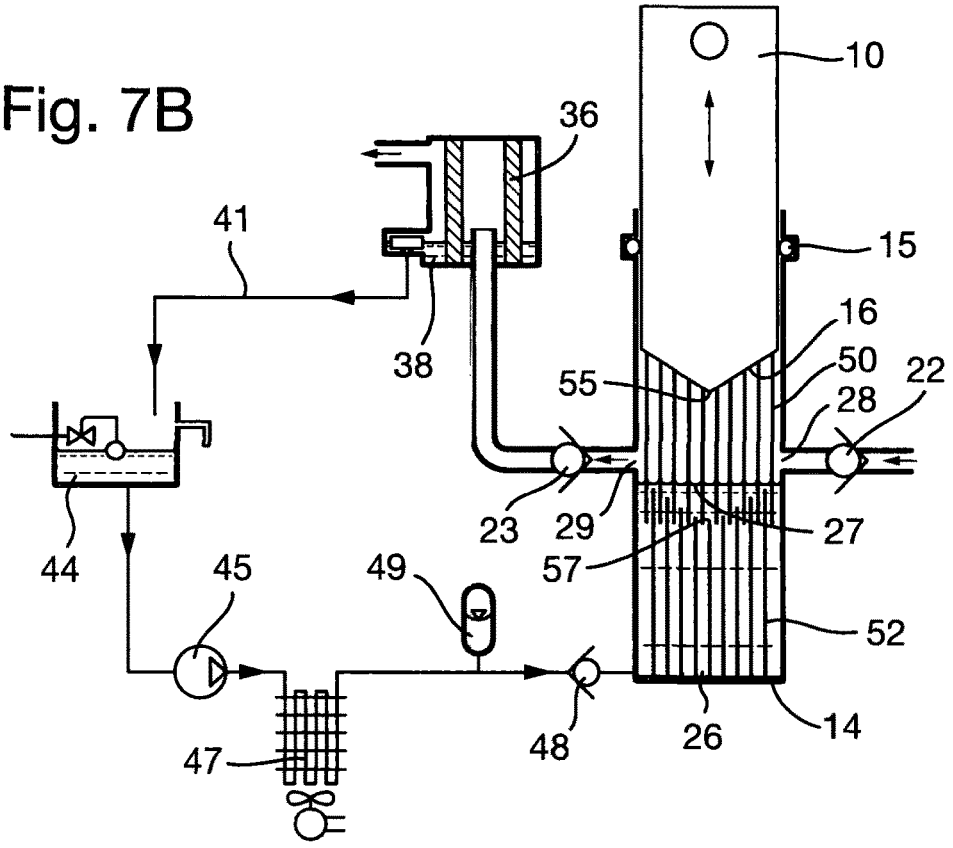
Figure 8A:
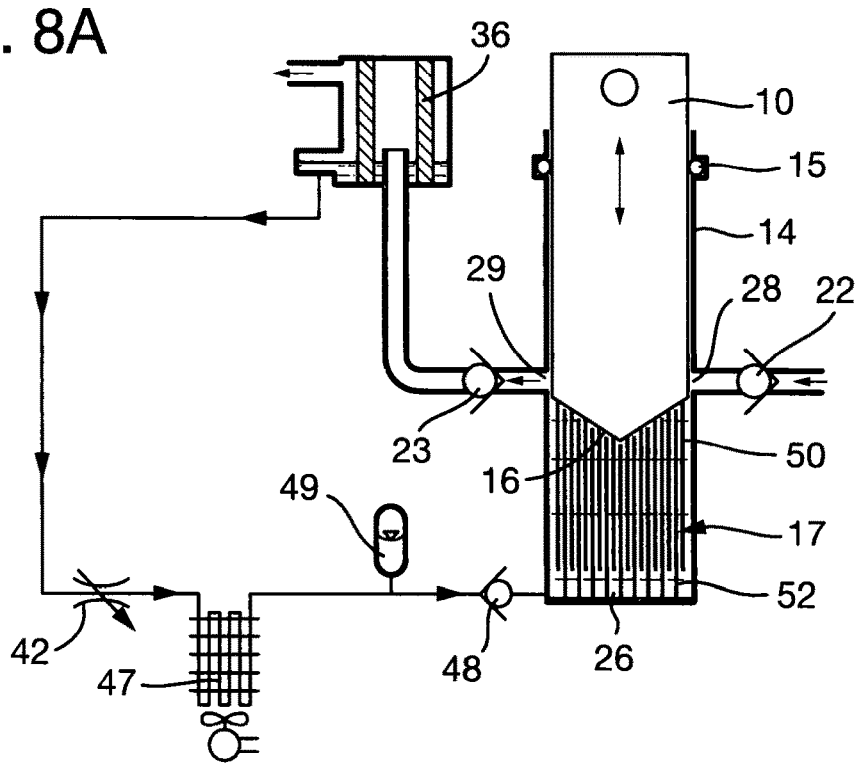
FIGS. 8A and 8B show a schematic view of a still further embodiment further of a near isothermal machine in accordance with the invention, in FIG. 8A the piston is inserted fully into the cylinder, and in FIG. 8B partially withdrawn.
Figure 8B:
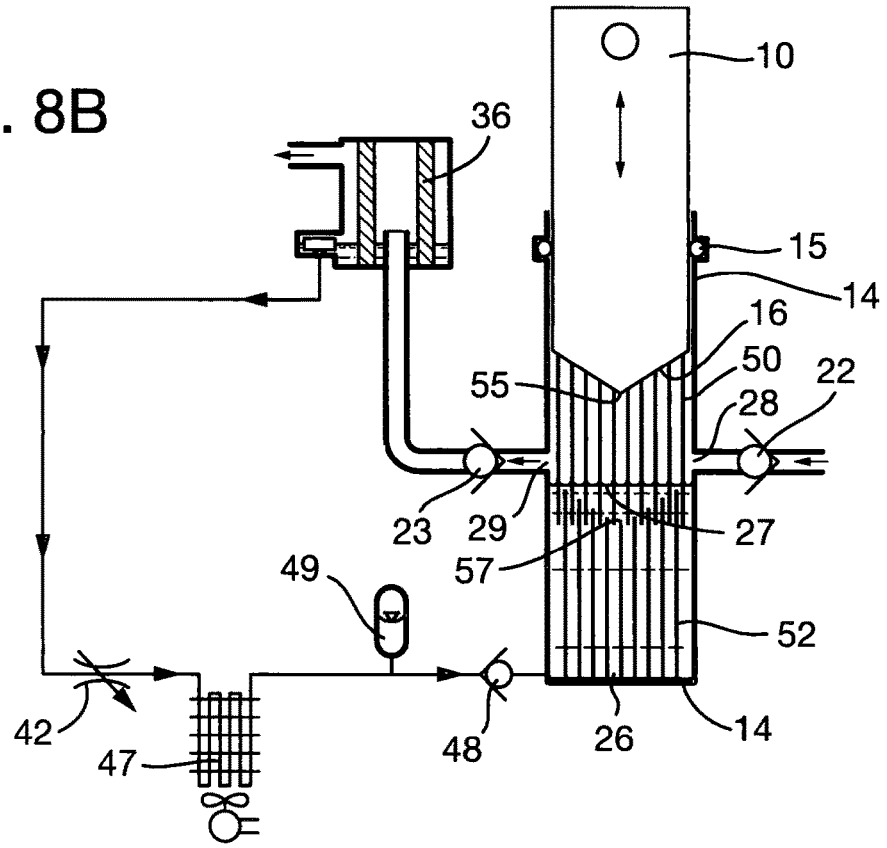

It will be noted that in FIGS. 7A and 7B and in FIGS. 8A and 8B the bottom 16 of piston 10 has a domed shape 55, and the top 57 of the baffle 52 is domed, these features help maximise the gas expulsion from the spiral on the compression stroke.

It will be noted that in FIGS. 8A and 8B and in FIGS. 9A and 9B bottom 16 of piston 10 has a domed shape 55, and the top 57 of the baffle 52 is domed, these features help maximise the gas expulsion from the spiral on the compression stroke.

The heat exchanger 47 can be placed anywhere between the outlet valve 23 and the base of cylinder 14. It is probably most conveniently placed in the position shown. Although the heat exchanger 47 is shown as a fanned radiator when the piston 10 and cylinder 14 are acting as a compressor, it could be any other form of cooler including a cooling tower. When the piston and cylinder are acting as an expander, the heat exchanger 47 would be a heater.

Figure 9:
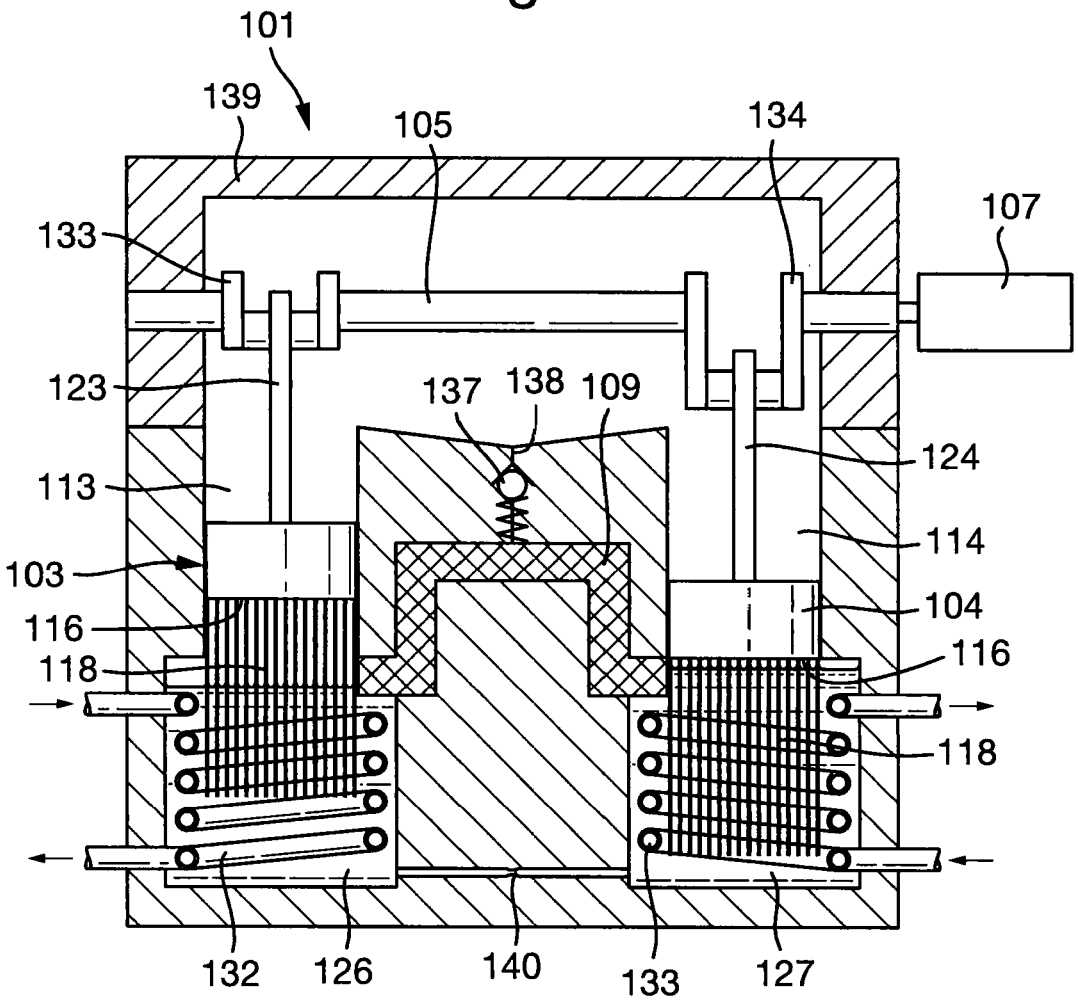
FIG. 9 is a schematic drawings of a pair of near isothermal machines working together as Stirling engines or heat pumps.
Figure 10:
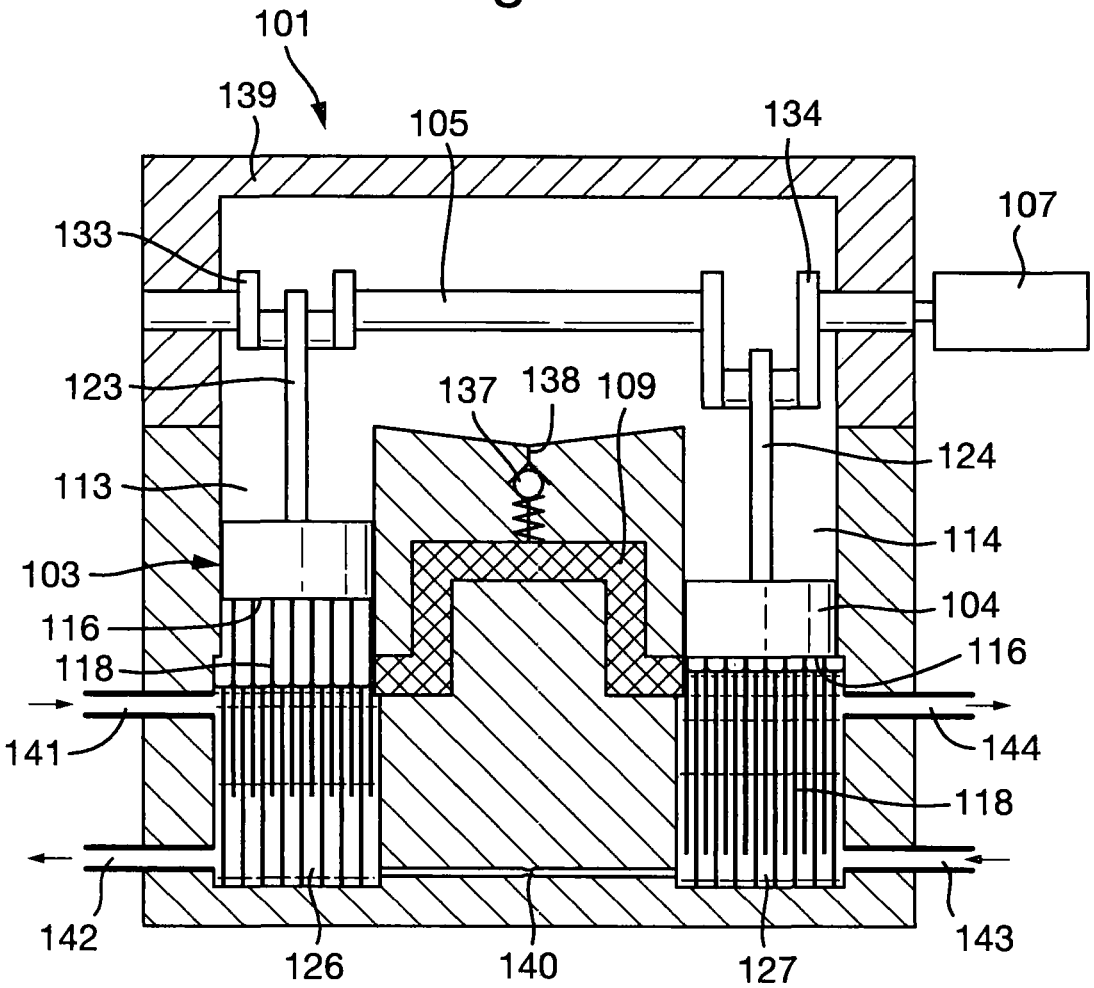
FIG. 10 shows a configuration of a pair of near isothermal machines according to the invention working together as a Stirling engine and suitable for us in a refrigerator or freezer

In FIGS. 9 and 10, Stirling cycle heat pumps using the invention are shown schematically.

In FIG. 9, the Stirling heat pump is shown in an Alfa configuration and the pistons are driven by a crankshaft. In FIG. 7*a* Sterling cycle heat pump 101 comprises a pair of pistons 103 and 104 operating in vertical cylinders 113 and 114 respectively. The pistons are mounted through piston rods 123 and 134 respectively to cranks 133 and 134 respectively onto a crank shaft 105. The crankshaft is rotated by a motor 107. The two pistons typically have phase lag of between 90°-120°.

In this simple illustration the crankshaft 105 is used but there are much more efficient mechanisms such as the Ross Linkage which would probably be used normally for production items as this will save space and be more cost effective.

Between the cylinders 103 and 104 is a regenerative heat exchanger 109 which is common to all Stirling heat pumps/engines. The regenerative heat exchanger 109 is in the form of an inverted "U" to allow liquid condensing in the heat exchanger to flow back to the cylinder from which it came.

Each piston and cylinder combination 103/113 and 104/114 is constructed in an analogous way to the piston cylinder combination of FIG. 1 or 4. A heat absorbing and releasing structure in the form of aluminium sheets 118 constructed as shown in FIGS. 2A to 2D attached to the bottom face 116 of each piston. There is hydraulic fluid 126 in the bottom of cylinder 113 and hydraulic fluid 127 in cylinder 114. The depth of fluid is up to the bottom face of a piston 103 or 104 at the end of its compression stroke. As a piston move up its cylinder on an expansion stroke the withdrawal of the parallel sheets 118 causes the level of the water to drop. Coils 132 (cylinder 113) and 133 (cylinder 114) through which flows fluid are immersed in the hydraulic fluid 126 and 127. Piston 103 and its cylinder 113 form the cold side of the heat pump and piston 104 and its cylinder 114 form the hot side of the heat pump.

The regenerative heat exchanger 109 follows classic Stirling cycle design and contains metal gauze such as of aluminium or aluminium alloy, or thin tubes. The shape of regenerative heat exchanger 109 as an inverted "U" is such that hot and cold hydraulic fluid from the cylinders 113 and 114 are separated and only gas can be transferred between the pistons, in this way the regenerative heat exchanger 109 acts as the coalescer 36 illustrated in FIG. 6 preventing the escape from or transfer of fluid between the cylinders.

The best gas to use in this application is helium. The hydraulic fluid 126 would need to remain a liquid at the lowest operating temperature. As a result plain water is probably not appropriate in most cases. But for general less demanding applications use of water with antifreeze could be appropriate, otherwise a fluid with a lower freezing point would be needed, there are many common liquids that would suffice.

The piston seals are omitted for clarity but some of the gas and hydraulic fluid in the heat pump may leak past the piston seals, and any hydraulic fluid and gas which leaks past the piston seals will be transferred back into the heat pump via a drain 135 and check valve 137. This can occur every cycle when the pressure in the heat pump is at its minimum. The whole system is contained in a hermetically sealed unit 139 to prevent loss of fluid and gas to the environment.

Over time there will be a small transfer of vapour from the hydraulic fluid 126 in the cold side to the fluid 127 in the hot side hot side of the heat pump so an imbalance in fluid levels could occur. To ensure the fluid levels remain the same on both sides of the heat pump there is a very small balance orifice 140. This will allow a very slow transfer of fluid back in the opposite direction.

Stirling machines can usually be designed to operate as an engine or a heat pump and this is the case with this invention. However as an engine the system efficiency is reduced by the transfer of vapour from the hot to the cold side of the engine without doing any useful work.

Inside both an engine and a heat pump, vapour will be transferred from the expander to the compressor side. In an engine the expander is on the hot side 104/114 as described and the compressor 103/113 is on the cold side, this allows the transfer of heat without doing any useful work. In a heat pump the expander is on the cold side 103/113 and the compressor is on the hot side 104/114 so any transfer of vapour assist in moving heat from the cold to hot side.

A Stirling heat pump or engine should be designed so that the working gas pressure in the cylinders 113, 114 and regenerative heat exchangers 109 is significantly higher than the vapour pressure of the hydraulic fluid 127 to prevent the free movement of hydraulic fluid vapour from the hot to the cold side (i.e. more gas molecules than vapour molecules so blocking the vapour molecules free movement).

The device works in practice by the compressor side 104/114 compressing helium (or other working gas) isothermally, as result of the parallel sheets working in combination with the hot fluid 127 in the bottom of cylinder 114, maintained by cooler fluid passing though the coil 133. The helium passes through the regenerative heat exchanger pulled by the action of the expander combination of piston 103/113, the temperature of each element of the regenerative heat exchanger is increased by a small amount as in a classic Stirling cycle, as the compression piston 104 passes bottom dead centre the flow of helium though the regenerative heat exchanger 109 is reversed and the temperature of each element of the heat exchanger decreases by the same small amount that it originally increased. In doing so heat is taken up in the helium from the hydraulic fluid 126 on the cold side and transported to the hot side. It is this heat which is then given up to the fluid 127 on the compression stroke of the piston 104; this heat is removed by the fluid flow through coil 133. The machine of FIG. 9 can be used for general heat pumps, for example.

Although in all the illustrated examples the cylinder is vertical, it can be inclined to the vertical. Two cylinders can act together as a Stirling engine in the way illustrated in FIG. 9, both cylinders being inclined in a V-form. In practical terms the cylinders cannot be horizontal or near horizontal, and the practical maximum inclination is about 45 degrees to the vertical.

In FIG. 10 a Stirling cycle engine is shown which is similar to that of FIG. 9 but with the coils 132 and 133 omitted, and the hydraulic fluid 126 and 127 in the cylinders 113 and 114 circulates through inlet 141 and outlet 142 (cylinder 113) and inlet 143 and outlet 144 (cylinder 114). In this embodiment the preferred hydraulic fluids was a refrigerant. The outlet 144 is connected, for example, to a refrigerator or freezer, where the hydraulic extracts heat and is recirculated to inlet 143. The heat is then given up in the engine 101 to the fluid 126 in the hot side in cylinder 113.

Fluid 126 is circulated through outlet 142 to a cooler, for example the external heat exchanger on a freezer or refrigerator where it loses heat before being recycled to the inlet 141 at the bottom of cylinder 113

The description of FIG. 10 is an illustrative example of the application of a Stirling cycle engine incorporating the invention, many other potential applications, such as air conditioning systems, will be apparent to those in the field.

The invention claimed is:

1. A machine for compressing or expanding gas comprising:

a piston, a cylinder inclined to the vertical or near vertical, a heat absorbing and releasing structure attached to and disposed orthogonally to the bottom of the piston, the piston operating downwards in a compression stroke with respect to a cylinder and upwards with respect to the cylinder in an expansion stroke, and wherein the cylinder contains a constant volume of liquid maintained at a constant temperature and a variable volume of gas at the same constant temperature; and an external cooling and heating circuit through which liquid from the cylinder is circulated.

2. A machine according to claim 1, wherein the heat absorbing and releasing structure comprises a plurality of sheets arranged in concentric arcs attached to and disposed orthogonally to a bottom of the piston.

3. The machine according to claim 1 in which ends of the sheets away from the bottom of the piston are rounded toward edges of the sheets.

4. The machine according to claim 1 further comprising a plurality of baffles mounted on a base of the cylinder and projecting upwards into the cylinder, the baffles being configured with shapes corresponding to elements of the heat absorbing and releasing structure and between which the elements of the heat absorbing and releasing structure may enter and leave as the piston reciprocates within the cylinder.

5. The machine according to claim 1 in which the heat absorbing and releasing structure is out of the liquid when the gas volume is at its maximum.

6. The machine according to claim 1 in which gas from the cylinder is passed through a fluid coalescer to condense fluid in gas displaced from the cylinder, the fluid condensed in the coalesce being passed through a fluid duct and returned.

7. The machine according to claim 1 further comprising a heat transfer surface around the cylinder, heat being transferred through the heat transfer surface by liquid flow adjacent to the surface to maintain the temperature of the liquid in the bottom of the cylinder substantially constant.

8. The machine according to claim 1 having air gas circulation over an external heat exchanger to cool or heat.

9. The machine according claim 1 having at least one nozzle attached to a gas inlet to cause swirl in the gas.

* * * * *